US007566055B2

(12) United States Patent
Spencer et al.

(10) Patent No.: US 7,566,055 B2
(45) Date of Patent: Jul. 28, 2009

(54) SUBSTRATE INVERTER SYSTEMS AND METHODS

(75) Inventors: Stan A. Spencer, Rochester, NY (US); Steven R. Moore, Rochester, NY (US); David M. Attridge, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 980 days.

(21) Appl. No.: 10/933,556

(22) Filed: Sep. 3, 2004

(65) Prior Publication Data

US 2006/0071406 A1 Apr. 6, 2006

(51) Int. Cl.
*B65H 39/10* (2006.01)

(52) U.S. Cl. ..... 271/301; 271/186; 271/902

(58) Field of Classification Search ..... 271/186, 271/301, 902

See application file for complete search history.

(56) References Cited

U.S. PATENT DOCUMENTS 4,359,217 A * 11/1982 Roller et al. ..... 271/186
4,462,681 A 7/1984 Aerts et al.
4,777,498 A 10/1988 Kasamura et al.
5,082,272 A * 1/1992 Xydias et al. ..... 271/186
5,317,372 A * 5/1994 Nakabayashi et al. ..... 399/370
5,337,135 A * 8/1994 Malachowski et al. ..... 399/401
5,438,435 A * 8/1995 Lawniczak ..... 358/496
5,449,160 A * 9/1995 Hou et al. ..... 271/3.15
5,467,182 A * 11/1995 Hower et al. ..... 399/364
5,473,419 A 12/1995 Russel et al.
5,629,762 A 5/1997 Mahoney et al.
5,666,629 A 9/1997 Kazoh
5,680,651 A 10/1997 Tsuji et al.
5,720,478 A 2/1998 Carter et al.
5,776,287 A 7/1998 Best et al.
5,791,645 A * 8/1998 Takada ..... 271/3.03
6,226,473 B1 5/2001 Kutsuwada
6,341,777 B1 * 1/2002 Carter ..... 271/291
6,350,072 B1 * 2/2002 Nunes et al. ..... 400/188
6,644,652 B1 * 11/2003 Walsh et al. ..... 271/186
6,769,682 B2 * 8/2004 Sumi et al. ..... 271/186
7,093,831 B2 * 8/2006 Biegelsen et al. ..... 271/184
2002/0070497 A1 6/2002 Morrison et al.
2002/0158404 A1 10/2002 Carter et al.
2003/0102624 A1 6/2003 Stoll
2003/0201598 A1 * 10/2003 Walsh et al. ..... 271/176

* cited by examiner

*Primary Examiner*—Patrick H Mackey
*Assistant Examiner*—Gerald W McClain
(74) *Attorney, Agent, or Firm*—Gibb I.P. Law Firm, LLC

(57) ABSTRACT

A sheet inverter includes a sheet path, such as a curved sheet path. A sheet driver is positioned to receive a sheet along the sheet path. The sheet driver is adapted to draw in the sheet and reverse a direction of the sheet. An exit path is positioned to receive the sheet from the sheet driver. An inverter path is also positioned to receive the sheet from the sheet driver. The curve of the sheet path biases the sheet's trailing edge into the exit path and the inverter path, and the sheet is directed to the exit path or the inverter path depending only upon how far the sheet is drawn into the sheet driver.

30 Claims, 4 Drawing Sheets

SUBSTRATE INVERTER SYSTEMS AND METHODS

CROSS REFERENCE TO RELATED APPLICATIONS

The present application is related to co-pending U.S. patent application Ser. No. 10/924,113, filed on Aug. 23, 2004, entitled "Printing System With Inverter Disposed For Media Velocity Buffering and Registration".

BACKGROUND

Embodiments herein generally relate to sheet substrate movement systems and methods. Devices described herein involve a sheet inverter/sorter used to turn sheets over and to direct sheets between various sheet paths.

SUMMARY

The systems and methods of embodiments herein provide a sheet inverter/director. The sheet inverter includes a sheet path, such as a curved sheet path. A sheet driver is positioned to receive a sheet along the sheet path. The sheet driver is adapted to draw in the sheet and reverse the direction of travel of the sheet. A first path (e.g., exit path) is positioned to receive the sheet from the sheet driver. Additional paths (e.g., an inverter path) are also positioned to receive the sheet from the sheet driver. The curve of the sheet path biases the sheet's trailing edge into the inverter path and the exit path successively, and the sheet is directed to the exit path or the inverter path depending upon how far the sheet is drawn into the sheet driver.

The exit path and the inverter path are positioned at different locations along the sheet path. The point where the exit path joins the sheet path comprises a first immovable feature that is positioned at the beginning of the exit path and is adapted to direct the sheet into the exit path. Similarly, the point where the inverter path joins the sheet path comprises a second immovable feature that is positioned at the beginning of the inverter path and is adapted to direct the sheet into the inverter path. The sheet path has a curve which directs the sheet's trailing edge into the exit path as the trailing edge of the sheet passes the exit path and into the inverter path as the trailing edge of the sheet passes the inverter path. The sheet inverter avoids using any movable or resilient gate features to direct the sheet's trailing edge into either the exit path or the inverter path. Instead, strain energy is released from the curved sheet as the sheet's trailing edge passes by the exit path and the inverter path, causing the trailing edge to flip into the respective path. Thus, the sheet can exit via either the exit path or the inverter path depending upon how far the sheet is drawn into the sheet driver. The sheet driver can comprise, for example, rollers adapted to frictionally move the sheet. Secondary sheet drivers can be positioned along the exit path and the inverter path to move the sheet along the exit path and the inverter path once the sheet has been directed into the exit path or the inverter path. The sheet driver is positioned at the end of the sheet path.

A method embodiment directs the sheet into the first path (e.g., exit path) or one of the additional paths (e.g., the inverter path) by directing the sheet along the sheet path, drawing the sheet into the sheet driver, and stopping the sheet in the sheet driver such that a trailing edge of the sheet is stopped adjacent to, and past either the first immovable feature that is positioned at the beginning of the exit path, or the second immovable feature that is positioned at the beginning of the inverter path. This process biases the trailing edge of the sheet into the exit path as the sheet passes the exit path and into the inverter path as the sheet passes the inverter path using only the curvature of the sheet path. The method then reverses the direction of travel of the sheet to cause the sheet to enter either the exit path or the inverter path depending upon which immovable feature the trailing edge of the sheet is stopped adjacent to (the sheet is directed to either the exit path or the inverter path depending only upon how far the sheet is drawn into the sheet driver and this process avoids using any form of movable gate).

The drawing, stopping, and reversing processes are performed using two nip rollers within the sheet driver that are adapted to frictionally move the sheet. Also, this method moves the sheet along the exit path and the inverter path using secondary sheet drivers positioned along the exit path and the inverter path once the sheet has been directed into one of the exit path and the inverter path.

These and other features are described in, or are apparent from, the following detailed description of various exemplary embodiments of systems and methods.

DETAILED DESCRIPTION

Figure 1:
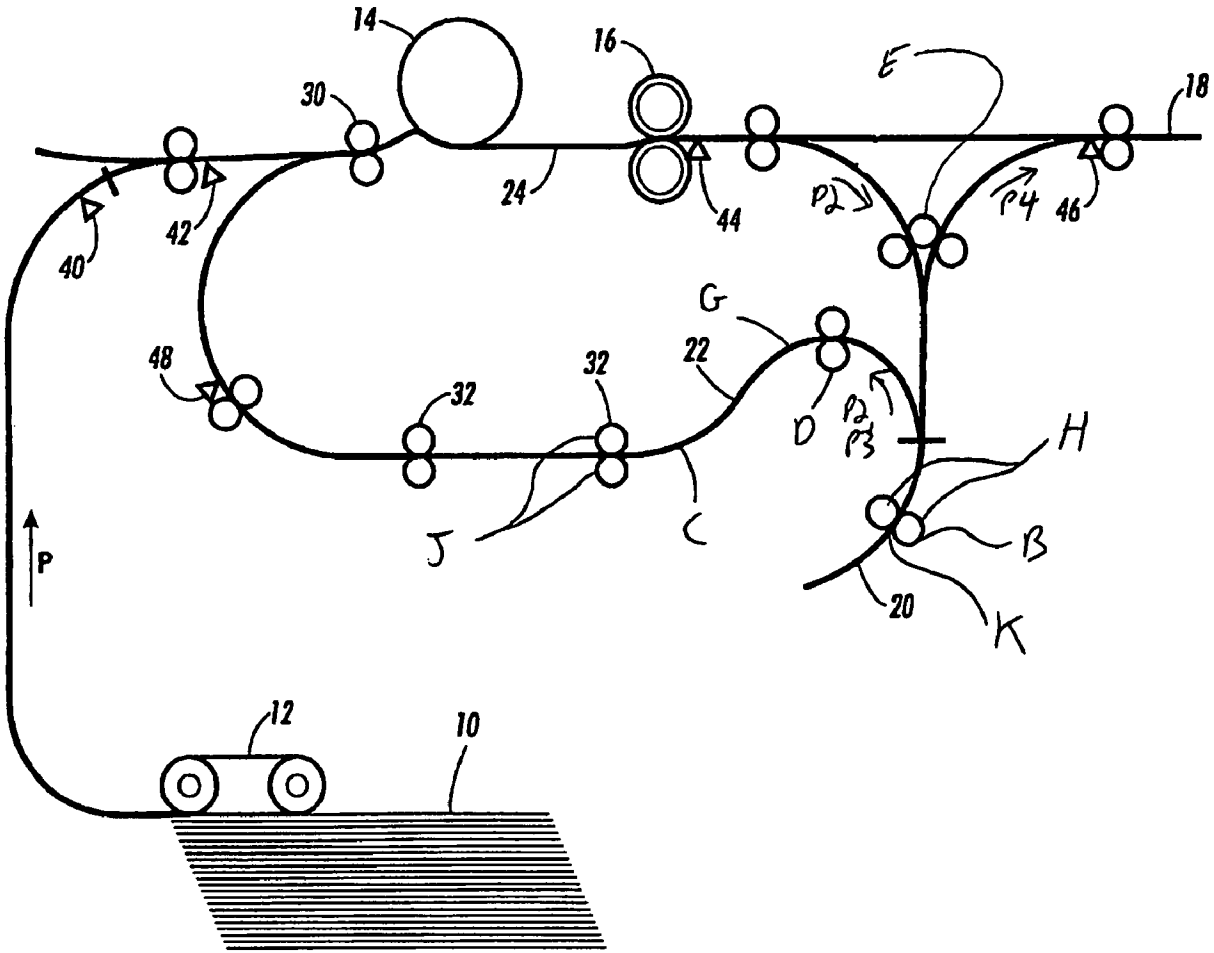
FIG. 1 is a schematic representation of a paper path.

FIG. 1 is a simplified elevational view of a simplexing/duplexing paper path as would be found, for example, in a digital or analog printer or copier. In the embodiment shown in FIG. 1, sheets (substrates) comprising any medium on which images are to be printed, such as paper, transparencies, boards, labels, etc., are drawn from a supply stack 10 by a feed mechanism 12. The sheets are moved along a primary loop 26 through process directions as indicated by the arrows in FIG. 1 by additional feed mechanisms 12 toward what can be generally called a "marking station" 14. In the illustrated embodiment, the marking station 14 includes a xerographic photoreceptor, but in other cases could include, for example, an intermediate transfer member and/or an ink-jet printing device. Also, in a xerographic embodiment, there is, downstream of marking station 14, a fuser 16. The feed mechanisms 12, marking unit 14, fuser 16, etc. can be controlled by one or more control units 28. As illustrated, the marking station 14 places a predetermined image on the upward-facing side of a sheet passing past it.

When it is desired to print a duplex or two-side-imaged sheet, the sheet is inverted and re-fed to the marking station 14 following receiving a first image on the first side thereof, so that the marking station 14 can place the second-side image. To perform such inverting and re-feeding, an inverter (indicated by box 20) and a duplex loop, indicated as 22, are used. The inverter 20 is shown in greater detail in FIG. 2. The inverter 20 includes a reversing feed mechanism 24 into which a sheet enters, and then exits in a reverse direction of motion.

The sheet feed mechanisms 12, 24 can comprise any form of device that is adapted to move a sheet or substrate. For example, the sheet feed mechanisms 12, 24 can include nip rollers or a belt adapted to frictionally move the sheet and can include air pressure or suction devices to produce sheet movement. The sheet feed mechanisms 12, 24 can include pairs of opposing wheels (one or both of which can be powered) that pinch the sheets Greater details on the operation of such sheet movement mechanisms are described in U.S. Patent Application Publications 2002/0070497, 2002/0158404, 2003/0102624, and 2003/0201598, the disclosures of which are incorporated herein by reference.

The duplex loop 22 conveys the sheet back to the marking station 14. As the sheet is in effect turned over by the action of inverter 20 and the duplex loop 22, the side of the sheet which had not received the initial image is placed face-up to receive the second-side image at the marking station 14. Following printing of the second-side image, the now "duplexed" sheet having printing on both sides is conveyed back to the inverter 20 and to exit 18. In the case of printing a "simplex" sheet, meaning a sheet having an image on only one side thereof, the sheet is sent directly from the inverter 20 to an exit 18 (which may be directed to, for instance, a catch tray or other finishing device, such as a stapler) without passing through the duplex loop 22.

Figure 2:
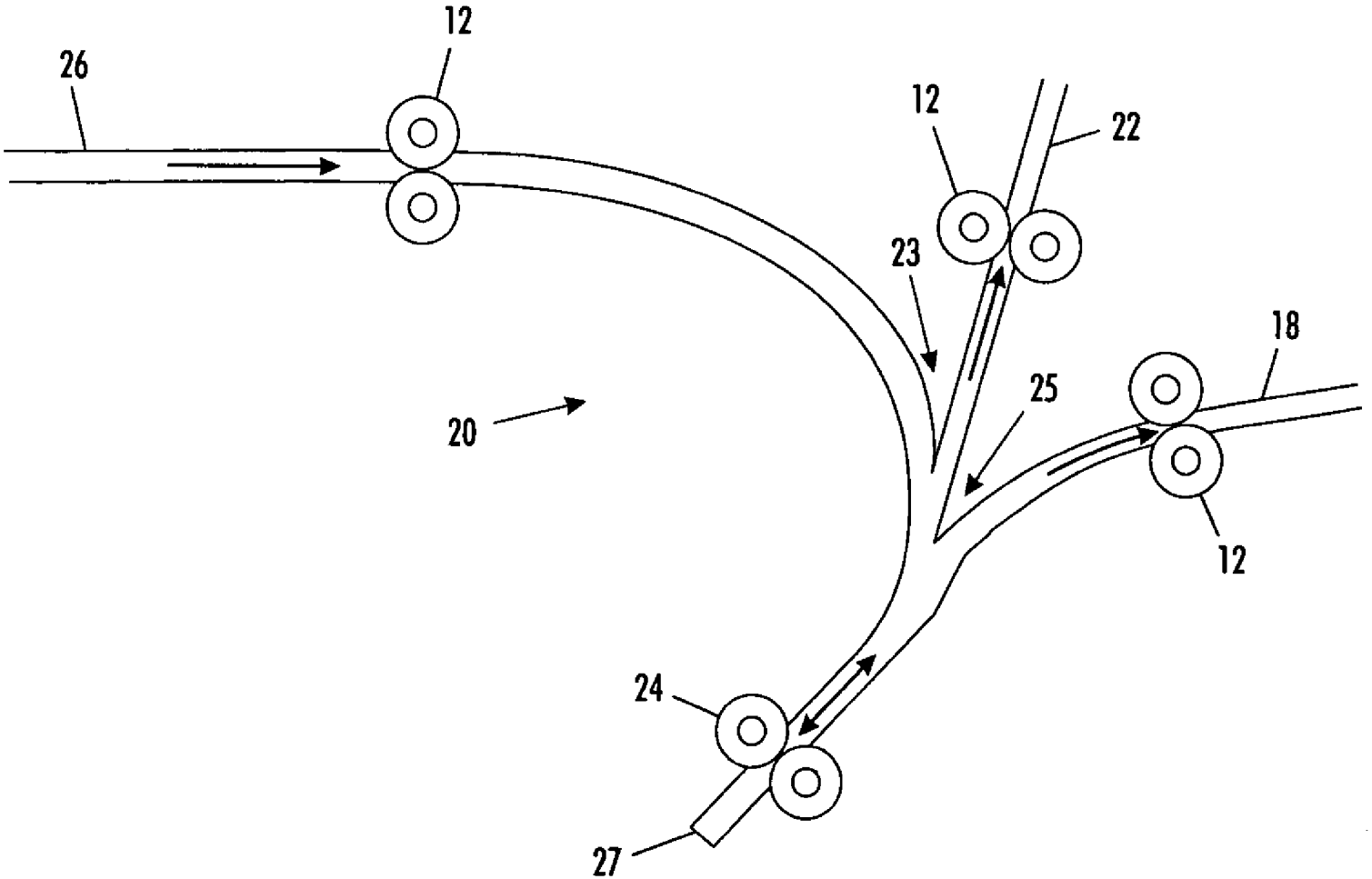
FIG. 2 is a schematic representation of an inverter/sorter.

FIG. 2 illustrates the sheet inverter 20 shown in FIG. 1 in greater detail. The sheet inverter 20 includes a sheet path 26, such as a curved sheet path. The reversing feed mechanism 24 (sheet driver) is positioned to receive a sheet along the sheet path 26. The sheet driver 24 is adapted to draw in the sheet and reverse the direction of travel of the sheet. The exit path 18 is positioned to receive the sheet from the sheet driver 24. An inverter path 22 is also positioned to receive the sheet from the sheet driver 24. The point where the exit path 18 joins the sheet path 26 comprises a first immovable feature 23 that is positioned at the beginning of the exit path 18 and is adapted to direct the sheet into the exit path 18. Similarly, the point where the inverter path 22 joins the sheet path 26 comprises a second immovable feature 25 that is positioned at the beginning of the inverter path 22 and is adapted to direct the sheet into the inverter path 22.

The curve of the sheet path 26 biases the sheet into the exit path 18 and the inverter path 22, and the sheet is directed to the exit path 18 or the inverter path 22 depending upon how far the sheet is drawn into the sheet driver 24. The actual curvature of the sheet path 26 will vary depending upon the intended use for the printer or copier and any curvature will be acceptable so long as sufficient bias is created to force the trailing edges of the sheets into the respective paths as they pass those paths. Therefore, if the inverter 20 is to be used with thick substrate sheets, less curvature will be used to prevent jamming. To the contrary, if the inverter 20 is to be used with thinner substrate sheets, more curvature will be used to ensure that the thinner sheets are properly biased into the respective paths.

The exit path 18 and the inverter path 22 are positioned at different locations along the curve of the sheet path 26. The curve in the sheet path 26 biases the sheet such that the curve directs the sheet into the exit path 18 as the trailing edge of the sheet passes the exit path 18 or into the inverter path 22 as the trailing edge of the sheet passes the inverter path 22. The sheet inverter 20 avoids using any movable or resilient gate feature. Secondary sheet drivers 12 can be positioned along the sheet path 26, exit path 18, and the inverter path 22 to move the sheet along these paths once the sheet has been directed into these paths. The sheet driver 24 is positioned at the end 27 of the sheet path 26.

While the foregoing has been described in conjunction with various exemplary embodiments, it is to be understood that many alternatives, modifications and variations would be apparent to those skilled in the art. Accordingly, Applicants intend to embrace all such alternatives, modifications and variations that follow in this spirit and scope.

Figure 3:
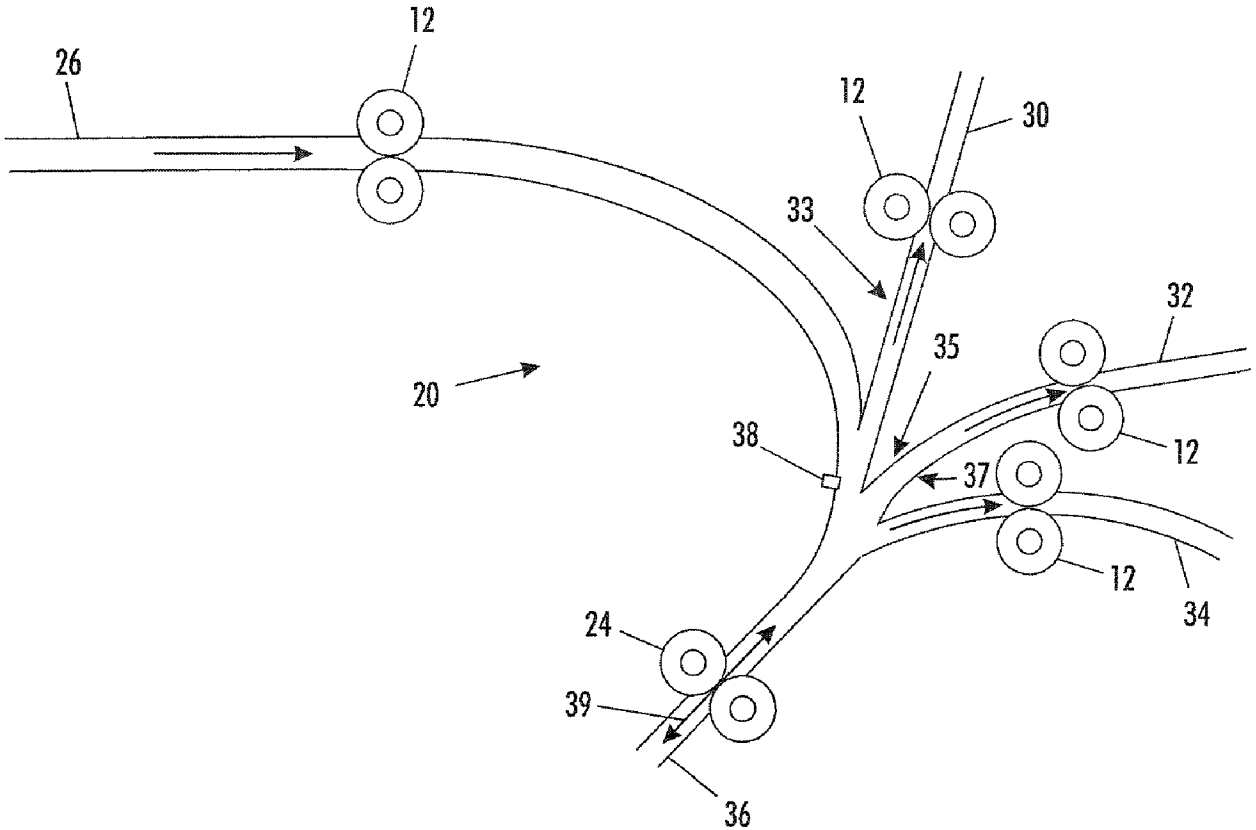
FIG. 3 is a schematic representation of an inverter/sorter.

For example, the sheet inverter 20 can be used to sort sheets for any purpose, such as sorting sheets according to different jobs, different colors, different print qualities, etc. In addition, as shown in FIG. 3, the sheet inverter/sorter 20 can include more than two output paths. For example, in FIG. 3, rather than only an inverter path 22 and an exit path 18, the sheet inverter/director 20 includes multiple paths 30, 32, 34, 36, etc. The point where the first path 30 joins the sheet path 26 comprises a first immovable feature 33 that is positioned at the beginning of the first path 30 and is adapted to direct the sheet into the first path 30. Similarly, the point where the second path 32 joins the sheet path 26 comprises a second immovable feature 35 that is positioned at the beginning of the second path 32 and is adapted to direct the sheet into the second path 32. Also, the point where the third path 34 joins the sheet path 26 comprises a third immovable feature 37 that is positioned at the beginning of the third path 34 and is adapted to direct the sheet into the third path 34.

Thus, depending upon how far a sheet 39 is drawn into the reversing feed mechanism 24, a sheet can be directed to the first sheet path 30, the second sheet path 32, the third sheet path 34, or the sheet driver 24 can continue moving the sheet in the same direction without reversing the sheet such that the sheet is directed to the fourth sheet path 36. While two paths are shown in FIG. 2 and four paths are shown in FIG. 3, the sheet inverter/director 20 is not limited to these specific configurations and can include any number of sheet paths so long as the spacing between the paths permits the sheet driver 24 to reverse the sheet into the given sheet path, as limited by the length of the sheets. In addition, to ensure that the sheets are properly biased into the respective paths 30, 32, 34, one or more air pressure or similar devices (e.g., air knife) 38 can be used to push the sheets toward the paths 30, 32, 34.

Figure 4:
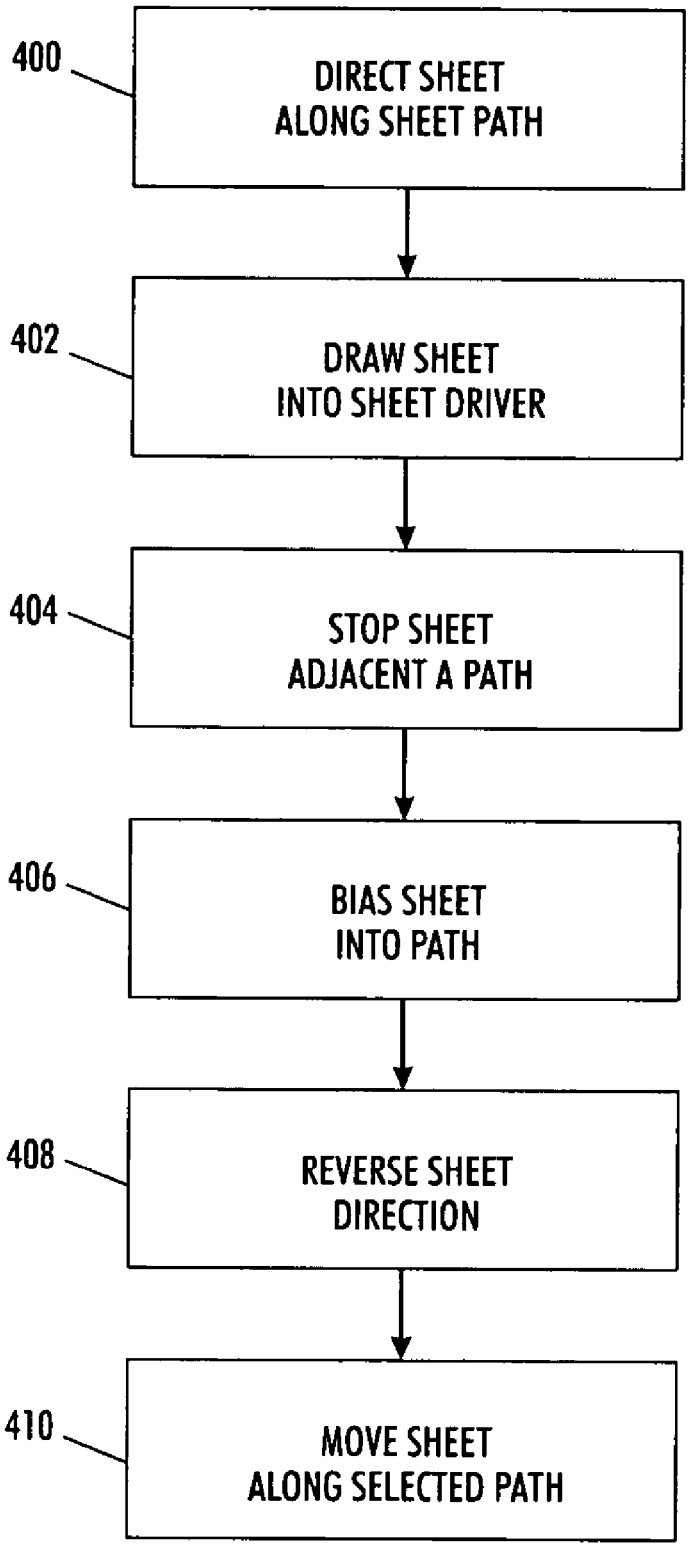
FIG. 4 is a flow diagram illustrating an embodiment of the invention.

FIG. 4 illustrates a method embodiment that directs the sheet into the first path (e.g., exit path) or one of the additional paths (e.g., the inverter path). As shown in item 400, the method directs the sheet along the sheet path 26. In item 402 the sheet is drawn into the sheet driver 24, 402, and the sheet is then stopped 404 by the sheet driver 24 with the trailing edge of the sheet being adjacent one of the paths in item. Alternatively, the sheet could continue along path 36, as discussed above. Thus, the trailing edge of the sheet is stopped adjacent to, and just slightly past either the first immovable feature 23, 33 that is positioned at the beginning of the first path 30 (inverter path 22), the second immovable feature 25, 35 that is positioned at the beginning of the second path 32 (exit path 18), the third immovable feature 37 that is positioned at the beginning of the third path 34, etc. As shown in item 406, this process thus biases the trailing edge of the sheet into the first path 30, as the sheet passes the first path 30, and into the second 32 and third 34 paths as the sheet passes the additional paths using only the curvature of the sheet path (which could be aided by the air knife 38).

The method then reverses the direction of travel of the sheet (item 408) to cause the sheet to enter either the first path 30, the second path 32, the third path, etc., depending upon which immovable feature 33, 35, 37, etc. the trailing edge of the sheet is stopped adjacent to. The sheet is directed to one of the paths 30, 32, 34, 35 etc., depending only upon how far the sheet is drawn into the sheet driver, without using any form of movable or resilient gate.

The drawing 402, stopping 404, and reversing 408 processes can be performed using two nip rollers (or similar mechanisms) within the sheet driver 24 that are adapted to frictionally move the sheet. Also, this method moves the sheet along the selected path using secondary sheet drivers positioned along the selected path once the sheet has been directed into one of the paths 410.

Thus, as shown above, the sheet inverter avoids using any movable or resilient gate features and, instead, the sheet is directed to the exit path or the inverter path depending solely upon how far the sheet is drawn into the sheet driver. This substantially lowers the cost and increases reliability of the device by eliminating many moving parts. It also results in faster inverter operation since no movable gate mechanism must be repositioned before sheet reversal can begin. This allows the sheet to be reversed as soon as it has stopped at the appropriate path. There is also less likelihood of paper or image damage, especially compared to a gate consisting of a series of discrete movable or resilient fingers. Finally, in the event that a paper jam must be cleared by the customer, there are fewer impediments for extraction of sheets.

What is claimed is:

1. A sheet inverter comprising:

a sheet path;

a sheet driver positioned to receive a sheet along said sheet path, wherein said sheet driver is adapted to draw in said sheet and reverse a direction of travel of said sheet;

an exit path positioned along said sheet path to receive said sheet from said sheet driver;

a first immovable feature, that is immovable with respect to said sheet path and said exit path, positioned at a beginning of said exit path adapted to direct said sheet into said exit path;

an inverter path positioned along said sheet path to receive said sheet from said sheet driver; and a second immovable feature, that is immovable with respect to said sheet path and said inverter path, positioned at a beginning of said inverter path adapted to direct said sheet into said inverter path, wherein said exit path and said inverter path are positioned at different locations along said sheet path and are positioned with respect to each other such that said sheet is directed to one of said exit path and said inverter path depending only upon how far said sheet is drawn into said sheet driver.

2. The sheet inverter according to claim 1, wherein said sheet path has a curve which biases a trailing edge of said sheet into said exit path as said sheet passes said exit path and into said inverter path as said sheet passes said inverter path.

3. The sheet inverter according to claim 1, wherein said sheet driver comprises two rollers adapted to frictionally move said sheet.

4. The sheet inverter according to claim 1, wherein said sheet inverter avoids using a gate.

5. The sheet inverter according to claim 1, further comprising secondary sheet drivers positioned along said exit path and said inverter path to move said sheet along said exit path and said inverter path once said sheet has been directed into one of said exit path and said inverter path.

6. The sheet inverter according to claim 1, wherein said sheet driver is positioned at an end of said sheet path.

7. A sheet inverter comprising:

a sheet path;

a sheet driver positioned to receive a sheet along said sheet path, wherein said sheet driver is adapted to draw in said sheet and reverse a direction of travel of said sheet;

an exit path positioned along said sheet path to receive said sheet from said sheet driver; and an inverter path positioned along said sheet path to receive said sheet from said sheet driver, wherein a curve of said sheet path biases a trailing edge of said sheet into beginnings of said exit path and said inverter path, and wherein said beginnings of said exit path and said inverter path are positioned at different locations along said sheet path and are positioned with respect to each other such that said sheet is directed to one of said exit path and said inverter path depending upon how far said sheet is drawn into said sheet driver.

8. The sheet inverter according to claim 7, wherein said curve of said sheet path biases said trailing edge of said sheet into said exit path as said sheet passes said exit path and into said inverter path as said sheet passes said inverter path.

9. The sheet inverter according to claim 7, wherein said sheet driver comprises two rollers adapted to frictionally move said sheet.

10. The sheet inverter according to claim 7, wherein said sheet inverter avoids using a gate.

11. The sheet inverter according to claim 7, further comprising secondary sheet drivers positioned along said exit path and said inverter path to move said sheet along said exit path and said inverter path once said sheet has been directed into one of said exit path and said inverter path.

12. The sheet inverter according to claim 7, wherein said sheet driver is positioned at an end of said sheet path.

13. A sheet director comprising:

a curved sheet path;

a sheet driver positioned to receive a sheet along said sheet path, wherein said sheet driver is adapted to draw in said sheet and reverse a direction of travel of said sheet;

an first path positioned along said sheet path to receive said sheet from said sheet driver; and at least one additional path positioned along said sheet path to receive said sheet from said sheet driver, wherein a curve of said sheet path biases a trailing edge of said sheet into beginnings of said first path and said additional path, and wherein said beginnings of said first path and said additional path are positioned at different locations along said sheet path and are positioned with respect to each other such that said sheet is directed to one of said first path and said additional path depending upon how far said sheet is drawn into said sheet driver.

14. The sheet director according to claim 13, wherein said curve of said sheet path biases said trailing edge of said sheet into said first path as said sheet passes said first path and into said additional path as said sheet passes said additional path.

15. The sheet director according to claim 13, wherein said sheet driver comprises two rollers adapted to frictionally move said sheet.

16. The sheet director according to claim 13, wherein said sheet director avoids using a gate.

17. The sheet director according to claim 13, further comprising secondary sheet drivers positioned along said first path and said additional path to move said sheet along said first path and said additional path once said sheet has been directed into one of said first path and said additional path.

18. The sheet director according to claim 13, wherein said sheet driver is positioned at an end of said sheet path.

19. A method of directing a sheet into one of an exit path and an inverter path positioned along a sheet path, said method comprising:

directing said sheet along said sheet path;

drawing said sheet into a sheet driver;

stopping said sheet in said sheet driver such that a trailing edge of said sheet is stopped adjacent to one of:

a beginning of said exit path; and a beginning of said inverter path; and reversing a direction of travel of said sheet to cause said sheet to enter one of said exit path and said inverter path depending upon which path said trailing edge of said sheet is stopped adjacent to, wherein said beginning of said exit path and said beginning of said inverter path are positioned at different locations along said sheet path and are positioned with respect to each other such that said sheet is directed to one of said exit path and said inverter path depending upon how far said sheet is drawn into said sheet driver.

20. The method according to claim 19, further comprising biasing a trailing edge of said sheet into said exit path as said sheet passes said exit path and into said inverter path as said sheet passes said inverter path using a curvature of said sheet path.

21. The method according to claim 19, wherein said drawing, stopping, and reversing processes are performed using two nip rollers within said sheet driver that are adapted to frictionally move said sheet.

22. The method according to claim 19, wherein said process of causing said sheet to enter one of said exit path and said inverter path avoids using a gate.

23. The method according to claim 19, further comprising moving said sheet along said exit path and said inverter path using secondary sheet drivers positioned along said exit path and said inverter path once said sheet has been directed into one of said exit path and said inverter path.

24. The method according to claim 19, wherein said sheet driver is positioned at an end of said sheet path.

25. A method of directing a sheet into one of an exit path and an inverter path positioned along a curved sheet path, said method comprising:

directing said sheet along said sheet path;

drawing said sheet into a sheet driver;

stopping said sheet in said sheet driver such that a trailing edge of said sheet is stopped adjacent to one of:

a beginning of said exit path, wherein a curve of said sheet path biases a trailing edge of said sheet into said exit path; and a beginning of said inverter path, wherein a curve of said sheet path biases a trailing edge of said sheet into said inverter path; and reversing a direction of travel of said sheet to cause said sheet to enter one of said exit path and said inverter path, wherein said beginning of said exit path and said beginning of said inverter path are positioned at different locations along said sheet path and are positioned with respect to each other such that said sheet is directed to one of said exit path and said inverter path depending upon how far said sheet is drawn into said sheet driver.

26. The method according to claim 25, further comprising biasing a trailing edge of said sheet into said exit path as said sheet passes said exit path and into said inverter path as said sheet passes said inverter path using only a curvature of said sheet path.

27. The method according to claim 25, wherein said drawing, stopping, and reversing processes are performed using two nip rollers within said sheet driver that are adapted to frictionally move said sheet.

28. The method according to claim 25, wherein said process of causing said sheet to enter one of said exit path and said inverter path avoids using a gate.

29. The method according to claim 25, further comprising moving said sheet along said exit path and said inverter path using secondary sheet drivers positioned along said exit path and said inverter path once said sheet has been directed into one of said exit path and said inverter path.

30. The method according to claim 25, wherein said sheet driver is positioned at an end of said sheet path.

* * * * *